US009388989B2

(12) United States Patent
Zhou

(10) Patent No.: US 9,388,989 B2
(45) Date of Patent: Jul. 12, 2016

(54) FIREPLACE OF COMBUSTING GASIFIED LIQUID FUEL

(75) Inventor: Wei Zhou, Ningbo (CN)

(73) Assignee: Ningbo Richen Electrical Appliance Co., Ltd, Ningbo (CN)

( * ) Notice: Subject to any disclaimer, the term of this patent is extended or adjusted under 35 U.S.C. 154(b) by 365 days.

(21) Appl. No.: 14/233,173

(22) PCT Filed: Aug. 18, 2011

(86) PCT No.: PCT/CN2011/001372

§ 371 (c)(1),
(2), (4) Date: Jan. 16, 2014

(87) PCT Pub. No.: WO2013/016847

PCT Pub. Date: Feb. 7, 2013

(65) Prior Publication Data

US 2014/0158111 A1 Jun. 12, 2014

(30) Foreign Application Priority Data

Jul. 29, 2011 (CN) ..... 2011 1 0219779

(51) Int. Cl.

| | |
|---|---|
| ***F24B 1/199*** | (2006.01) |
| ***F23K 5/00*** | (2006.01) |
| ***F23K 5/20*** | (2006.01) |
| ***F23K 5/22*** | (2006.01) |
| ***F23D 14/10*** | (2006.01) |
| ***F23D 14/28*** | (2006.01) |

(Continued)

(52) U.S. Cl.

CPC ..... *F24B 1/199* (2013.01); *F23D 11/448* (2013.01); *F23D 14/10* (2013.01); *F23D 14/28* (2013.01); *F23K 5/007* (2013.01); *F23K 5/20* (2013.01); *F23K 5/22* (2013.01); *F24C 5/02* (2013.01)

(58) Field of Classification Search

CPC ..... F24B 1/199; F23D 11/448; F23D 14/28; F23K 5/007; F23K 5/22

USPC ..... 126/512, 92 AC, 92 R, 500, 86; 431/333, 431/262, 75, 125

See application file for complete search history.

(56) References Cited

U.S. PATENT DOCUMENTS

| | | | | |
|---|---|---|---|---|
| 3,096,754 A * | 7/1963 | Solomon | ..... | F24B 1/1802 126/503 |
| 3,723,052 A * | 3/1973 | Nakashima | ..... | F23D 5/00 431/339 |
| 4,133,632 A * | 1/1979 | Nakano | ..... | F23D 5/045 431/328 |

(Continued)

FOREIGN PATENT DOCUMENTS

| | | |
|---|---|---|
| CN | 2342277 Y | 10/1999 |
| CN | 2556522 Y | 6/2003 |

(Continued)

*Primary Examiner* — Gregory Huson
*Assistant Examiner* — Nikhil Mashruwala
(74) *Attorney, Agent, or Firm* — The Webb Law Firm

(57) ABSTRACT

Disclosed is a fireplace of combusting gasified liquid fuel, which includes a fireplace body provided with a fireplace chamber. The fireplace body is provided with a cavity which is capable of accommodating a combustion device and formed at the bottom of the fireplace chamber. A fire viewport is provided at the front of the fireplace body. The combustion device includes a liquid supplying device, gasification chamber and burner. A slot used for exposing the burner is provided at the top of the cavity. A flame jet hole is arranged in the burner. A liquid fuel feeding port and a gas outlet are arranged in the gasification chamber.

18 Claims, 5 Drawing Sheets

(51) Int. Cl.
*F24C 5/02* (2006.01)
*F23D 11/44* (2006.01)

(56) References Cited

U.S. PATENT DOCUMENTS

| | | | | |
|---|---|---|---|---|
| 5,996,575 | A | 12/1999 | Shimek et al. | |
| 6,116,232 | A | 9/2000 | Valters et al. | |
| 6,267,113 | B1 * | 7/2001 | Maust | F24C 3/006 126/512 |
| 2002/0132205 | A1 | 9/2002 | Gore et al. | |
| 2007/0224558 | A1 * | 9/2007 | Flick | F23N 1/002 431/75 |
| 2009/0325114 | A1 | 12/2009 | Noman | |
| 2010/0043775 | A1 | 2/2010 | Phillips et al. | |
| 2011/0048402 | A1 | 3/2011 | Houle | |

FOREIGN PATENT DOCUMENTS

| | | | |
|---|---|---|---|
| CN | 2677776 | Y | 2/2005 |
| CN | 201706588 | U | 1/2011 |
| CN | 201724274 | U | 1/2011 |
| CN | 201819268 | U | 5/2011 |
| CN | 202171283 | U | 3/2012 |
| JP | 60057105 | A | 4/1985 |

* cited by examiner

FIREPLACE OF COMBUSTING GASIFIED LIQUID FUEL

CROSS-REFERENCE TO RELATED APPLICATIONS

This application is the United States national phase of International Application No. PCT/CN2011/001372 filed Aug. 18, 2011, and claims priority to Chinese Patent Application No. 201110219779.2 filed Jul. 29, 2011, the disclosures of which are hereby incorporated in their entirety by reference.

TECHNICAL FIELD

The present patent application relates to a fireplace, and particularly to a fireplace of combusting gasified liquid fuel.

BACKGROUND

Most of the traditional fireplaces use solid fuel for heating. However, the solid fuel itself is bulky and need much place for store, which makes the traditional fireplace occupy a large area. In addition, the traditional fireplace has low combustion efficiency and poor energy-saving effect.

With the continuous development of science and technology, the liquid fuel is becoming a clean energy with less pollution. It is lighter and takes fewer places than the solid fuel with same heat energy. Meanwhile, the liquid fuel is more convenient for store than gas fuel. The pipe for the liquid fuel is smaller than that of the gas fuel. Chinese utility model patent ZL201020033207.6, entitled "Liquid Convection Fireplace Heating Systems," provides a convection type liquid fireplace heating system. Chinese utility model patent ZL 200920263443.4, entitled "An Automatic Fuel Fireplace," discloses an automatic fuel fireplace. The fireplaces of the two patents use liquid fuel for combustion. However, the above two patents use direct combustion method for the liquid fuel to combust. These methods cannot combust sufficiently and the combustion efficiency is low. In addition, this method cannot control the combustion of liquid fuel effectively. To vaporize the liquid fuel before combustion is able to lower the combustion temperature and make the control of combustion easier. And the combustion flame is also improved. In order to improve the combustion efficiency of the liquid fuel, people use the method of vaporizing to realize combustion of the liquid fuel. However, the existing liquid fuel vaporizing structures are complex. In addition, the existing liquid fuel vaporizing structures are complicated and need pre-heating by igniting the fuel in the preheating burner ignition cup. The liquid fuel is usually exposed to the air which results in safe risks.

SUMMARY

The present patent application provides a fireplace of combusting gasified liquid fuel with simple structure, convenient installation and high combustion efficiency.

The present patent application provides a fireplace of combusting gasified liquid fuel which includes a fireplace body provided with a fireplace chamber. The fireplace body is provided with a cavity which is capable of accommodating a combustion device and formed at the bottom of the fireplace chamber. A fire viewport is provided at the front of the fireplace body. The combustion device includes a liquid supplying device, gasification chamber and burner. A slot used for the burner passing through and exposing is provided at the top of the cavity. A flame jet hole is arranged in the burner. A liquid fuel feeding port and a gas outlet are arranged in the gasification chamber. The liquid fuel feeding port of the gasification chamber is connected with the liquid supplying device, and the gas outlet of the gasification chamber is connected with the burner. The main body of the burner is provided higher than the connection port of the burner and the gasification chamber. An electric heating means is also provided in the gasification chamber.

Optionally, a demountable fireplace door is provided at the front of the fireplace body. The fire viewport is set up in the demountable fireplace door. This structure is advantageous as it facilitate installation and maintenance of the combustion device.

Optionally, to facilitate the installation of the electric heating means and improve the reliability of the installation, a through hole along the longitudinal direction is provided at the bottom of the gasification chamber. The electric heating means is interposed in the through hole. The electric heating means is mounted on the outer wall of the gasification chamber. The electric heating means can also be mounted directly in the inner wall of the gasification chamber. To mount the electric heating means on the outer wall of the gasification chamber can facilitate the installation, assembly and maintenance.

The electric heating means can be achieved by various methods. Preferably, the electric heating means is an electric heating metal tube, or a PTC heating element, or a heating resistance wire, or an electromagnetic induction heating coil.

The structure and shape of the burner can vary. The burner can be in a tubular shape with either straight pipe structure or bent pipe structure. The flame jet hole is provided at an interval along the longitudinal direction of the wall of the burner. The top of the gasification chamber is provided with a gas outlet port. The gas outlet port of the gasification chamber connects to the corresponding pipe orifice of the burner. This structure is advantageous as it reduces the volume and saves installation space. The gas outlet port of the gasification chamber can be provided at the side of the gasification chamber for ease of installation. The top or side of the gasification chamber can be provided with either one gas outlet port or two and more gas outlet ports. Meanwhile, the burner is provided with connection ports corresponding to the gas outlet ports of the gasification chamber respectively. The pipe orifice the burner can be bent at needed angle one or more times.

The combustion device further includes an electronic control means which controls the power and on-off status of the electric heating means. The burner is provided with a igniter close to the flame jet hole. The burner is provided with a flame detection means close to the flame jet hole. The flame detecting means detects whether the flame of the burner is at a normal operation status or not. The igniter, the flame detecting means and the electric heating means are electrically connected by the electronic control means. Therefore, the automatic ignition control can be achieved. The igniter ignites the burner automatically under the control of the electronic control means when the power is turned on. The flame detecting means is used to detect whether the flame is at normal operation status. If the flame is at a normal operation status, the electric heating means work normally. If the flame is at an abnormal operation status (such as the igniter fails to ignite or the flame quench), the flame detecting means send signal to the electronic control means. Then the electronic control means control the electric heating means to stop working.

In one embodiment, the outer side wall of the gasification chamber is provided with a temperature sensor which detects an operating temperature of the gasification chamber. The temperature sensor is also electrically connected to the electric control means. By this configuration, the safety of the combustion apparatus is guaranteed and the control of the heating power of the gasification chamber is more effective. The temperature sensor detects the operating temperature of the gasification chamber and compares it with a preset temperature. If the operating temperature is higher than the preset temperature, the temperature sensor sends a signal to the electronic control means. The electronic control means changes the heating power of the electronic heating means so that to reduce the heating power. If necessary, the electronic control means cut off electrical heating means power promptly to make it stop working. This configuration can prevent overheating of the gasification chamber.

In one embodiment, the liquid supply means includes a liquid fuel tank and a feed tube. The discharge port of the liquid fuel tank and the liquid fuel feeding port of the gasification chamber are connected via the feed tube. The feed tube is also provided with an electromagnetic pump which supplies power to deliver liquid fuel. The electromagnetic pump is electrically connected with the electrical control means. The electromagnetic pump can achieve automatic control of the liquid fuel delivery and thus improve the automation degree of the feeding.

In one embodiment, the top of the gasification chamber is provided with a liquid level hole. The liquid level hole is provided with a liquid level sensor which is electrically connected with the electronic control means. The liquid level sensor detects the liquid level signal and sends it to the electronic control means. If the liquid fuel in the gasification chamber is over capacity, the electronic control means controls the electromagnetic pump to shut off. If the liquid fuel in the gasification chamber is in a shortage, the electronic control means controls the electromagnetic pump to turn on or controls the electronic heating means to stop working. This configuration can improve the reliability and safety of gasification combustion. The liquid level sensor can judge how much fuel is in the gasification chamber and thus achieve an automatically control of the electromagnetic pump and electronic heating means. This configuration improves the automation and ensures the safety using. To further improve the reliability and safety of gasification combustion, a chamber can be set up separately to accommodate the liquid level sensor which is electrically liquid level connected to the electronic control means. The liquid level chamber can be connected with the electromagnetic pump and the gasification chamber via a pipeline.

Optionally, the electronic control means is connected with a carbon dioxide sensor which detects the concentration of indoor carbon dioxide. This configuration can prevent the content of indoor carbon dioxide being too high after the combustion of fireplace. When the concentration of indoor carbon dioxide exceeds a preset value, the carbon dioxide sensor sends a signal to the electronic control means. The electrical control means shuts off the power supply of the electronic heating means of the gasification chamber and the power supply of the electromagnetic pump of the fluid supply means. This fully ensures the user's safety.

Compared with the existing technology, the present patent application has the following advantages. Using the method of the gasification combustion of the liquid fuel, the fireplace is more clean and green, and has higher combustion efficiency, compared with traditional method using solid fuel. Being a small volume, the liquid fuel makes the structure of fireplace more compact. As the gasification chamber is directly heated by the electric heating means to provide a required heat to gasify liquid fuel without preheating, the whole structure is simpler and the gasification process is more simplified. Furthermore, the burner combustion temperature is below the boiling point of the liquid fuel at the start of combustion, and part of the vaporized liquid fuel is re-condensed to liquid after entering into the burner. Because the burner body of the present patent application is higher than the interface connecting the burner and the gasification chamber, the liquid fuel conveniently enters into the burner and re-condenses to liquid, and flows back into the gasification chamber due to its own gravity. This configuration ensures a full combustion of the fuel and thus improves the combustion efficiency.

DETAILED DESCRIPTION

Figure 2:
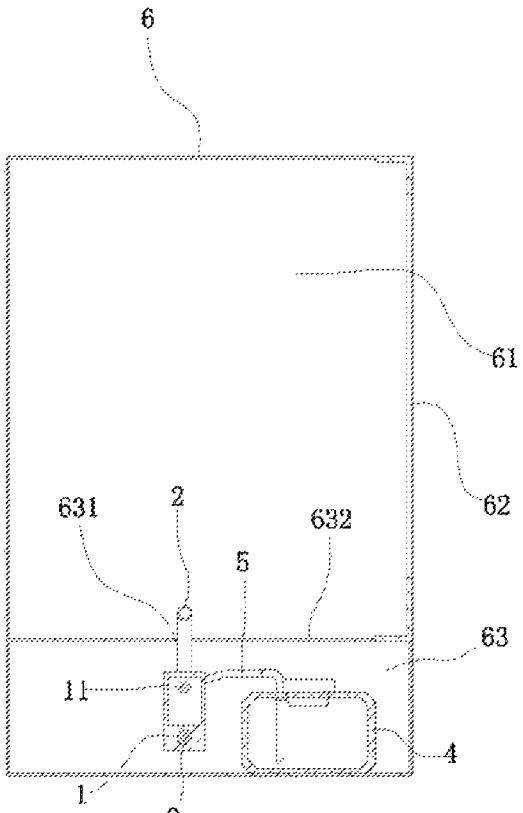
FIG. 2 is a cross-sectional view of the fireplace in FIG. 1.
Figure 1:
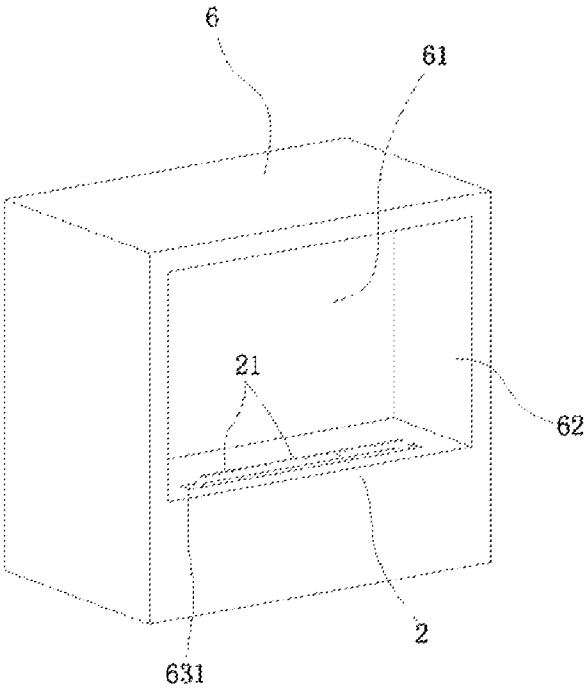
FIG. 1 is a structural view of a fireplace according to embodiment 1 of the present patent application.
Figure 3:
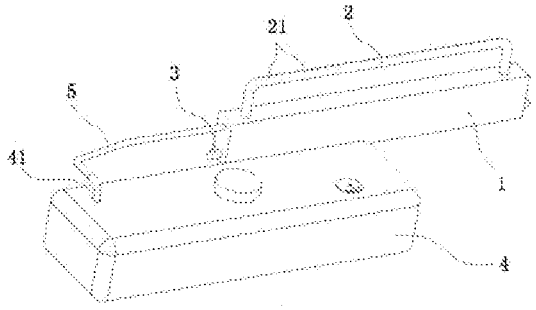
FIG. 3 is a structural view of the liquid combustion apparatus of embodiment 1 of the present patent application.

The present patent application is further described in details as below with reference to the figures.

Embodiment 1

Referring to FIGS. 1-4, a fireplace of combusting gasified liquid fuel includes a fireplace body 6. The fireplace body 6 is provided with a fireplace chamber 61. The fireplace body 6 is provided with a fire viewport 62 at the front of the fireplace body which is connected with the fireplace chamber 61. A cavity 63 is formed at the bottom of the fireplace chamber 61. The cavity 63 is placed with a combustion device for the gasified liquid fuel to burn.

The combustion device includes a gasification chamber 1, a burner 2, an electric heating means 3, a liquid fuel tank 4 and a feed tube 5. A slot 631 is provided at the top of the cavity 63. The burner 2 passes through the slot 631 and is exposed in the fireplace chamber 61. A liquid fuel feeding port 11 is arranged at the side wall of the gasification chamber 1. An outlet hole 41 is provided at the side wall of the liquid fuel tank 4. The two ends of the feed tube 5 are connected with the outlet hole 41 and the liquid fuel feeding port 11 respectively.

The burner 2 of this embodiment uses a straight pipe structure. The burner 2 is provided with a plurality of flame jet holes 21 which are arranged at a certain interval along the longitudinal direction of the burner 2. At least one gas outlet is arranged at the top of the gasification chamber 1. In this embodiment, the top of the gasification chamber 1 is provided with two gas outlet. Accordingly, the two pipe orifices 22 of the burner 2 bent downwards vertically. The two gas outlet of the gasification chamber 1 are connected with the two pipe orifices 22 of the burner 2. At the beginning of the burning, the temperature of the burner 2 is lower than the boiling point of the liquid fuel. Part of the vaporized liquid fuel enters into the burner 2 and re-condenses into liquid. Therefore, the main body of the burner 2 is higher than the connection port of the burner 2 and the gasification chamber 1. This configuration has the advantageous of making the re-condensed liquid fuel conveniently enter into the burner and flow back into the gasification chamber due to its own gravity. This configuration ensures full combustion of the fuel and thus improves the combustion efficiency.

Figure 4:
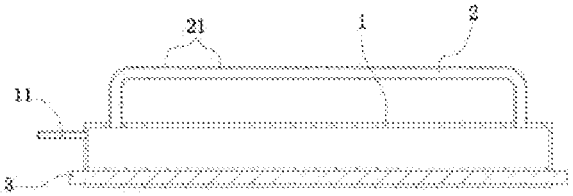
FIG. 4 is an assembly cross-sectional view of the gasification chamber and the burner in FIG. 3.

Referring to FIG. 4, the electronic heating means 3 can use the heating elements of various existing heating methods. The electronic heating means 3 mainly supply the energy for gasify the liquid fuel. For example, the electric heating means 3 can use a metal electric heating tube, or a PTC heating element, or a heating resistance wire, or an electromagnetic induction heating coil. The electronic heating means 3 is mounted on the outer wall of the gasification chamber 1. The electronic heating means can also be mounted directly in the inner wall of the gasification chamber 1. To facilitate the installation and maintenance, the electronic heating means 3 of the present embodiment use a metal heating tube. The bottom of the gasification chamber 1 is provided with a through hole along the longitudinal direction. The metal heating tube is inserted into the through hole.

In operating, the liquid fuel enters into the gasification chamber 1 from the liquid fuel feeding port 11. After the electronic heating means 3 is power on, the liquid fuel in the gasification chamber 1 is heated by the electronic heating means 3 and start evaporative expansion to produce pressure. The vaporized fuel enters into the burner 2 from the gas outlet port of the gasification chamber 1. When the vaporized liquid fuel emerges at the flame jet hole 21 at the top of the burner 2, igniting can be performed to get stable combustion. Either manual way or igniter can be used to realize ignition. When the valve is shut-off, the feed tube 5 stops the supply of liquid fuel. To turn off the electronic heating means 3 can stop the operating of the entire combustion device.

The fireplace of the present embodiment uses the combustion device which achieves the gasification combustion of liquid fuel. The combustion device uses electronic heating means for heating. By using a small amount of electronic power, a large heat for the combustion of the liquid fuel is obtained. This configuration eliminates the pre-heating process in the liquid fuel combusting of the prior art and simplifies the heating process. Only by turning on the electronic heating means, the liquid fuel can be gasified sustainably and stably. This configuration has lower cost and higher heating efficiency. In addition, it's more energy saving.

Embodiment 2

Figure 5:
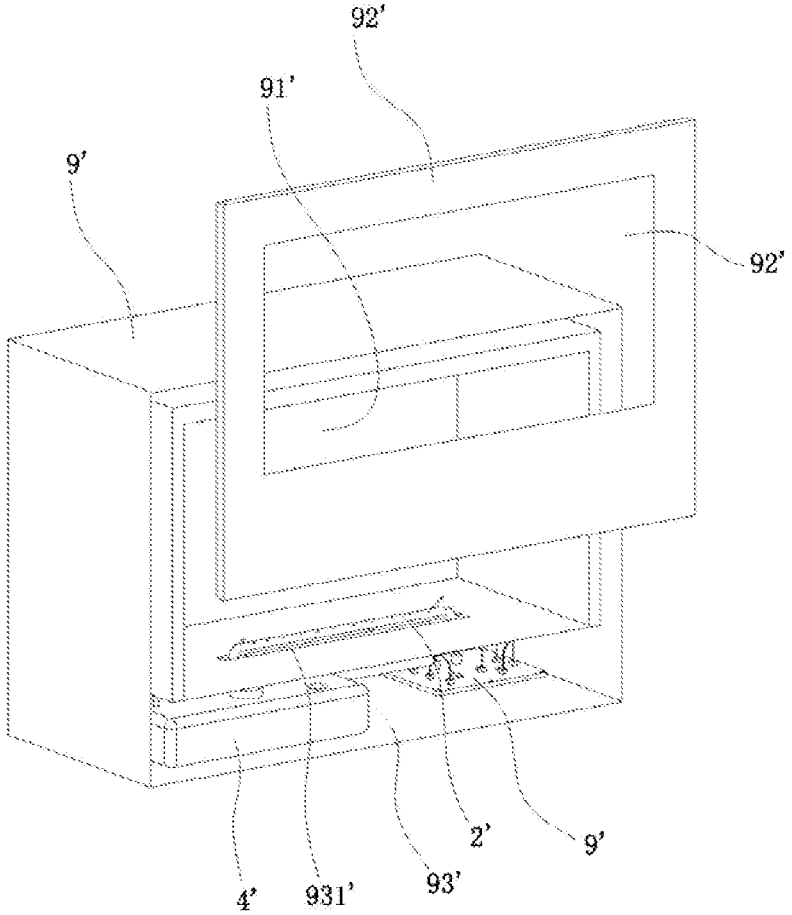
FIG. 5 is a structural view of the fireplace according to embodiment 2 of the present patent application.
Figure 6:
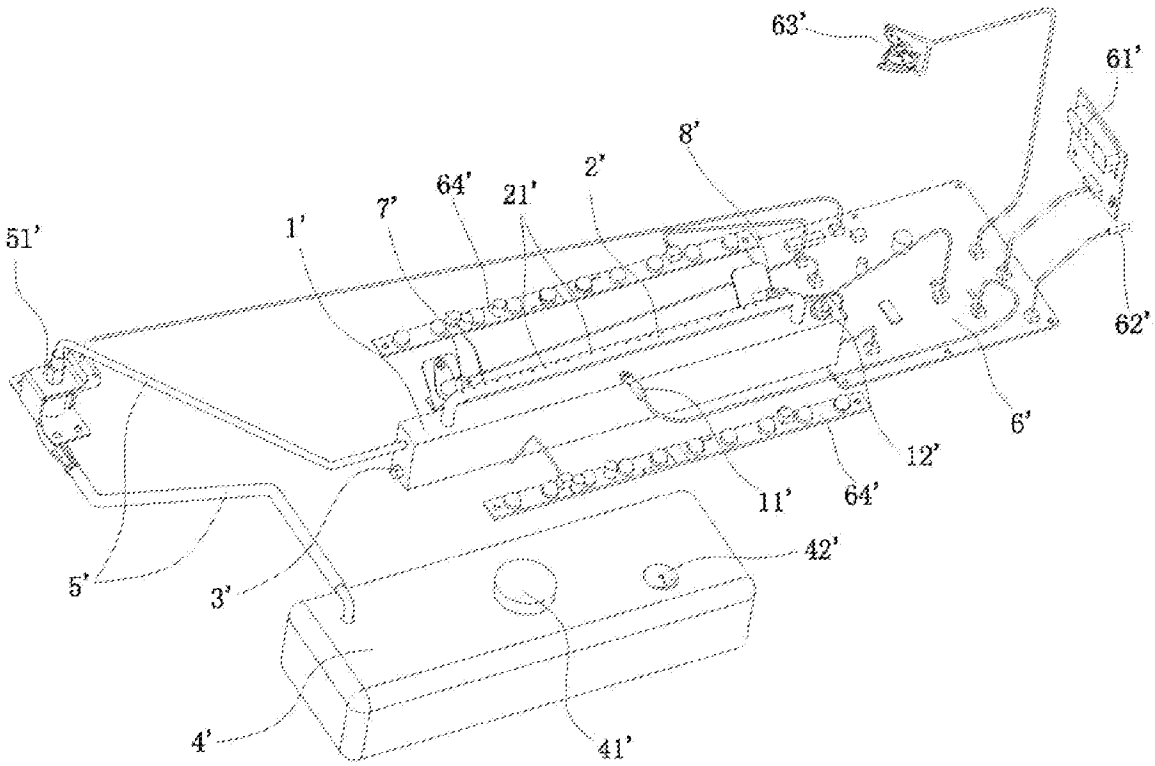
FIG. 6 is a structural view of the liquid combustion apparatus of embodiment 2 of the present patent application.
Figure 7:
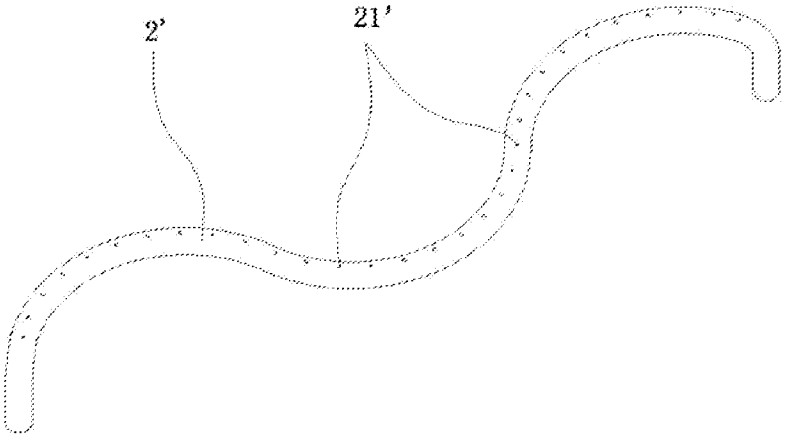
FIG. 7 is another structural view of the burner in FIG. 6.

Referring to FIGS. 5-7, the fireplace of embodiment 2 includes a fireplace body 9'. The fireplace body 9' is provided with a fireplace chamber 91' inside. The fireplace body 9' is provided with a dismountable fireplace door 92' at the front. The fireplace door 92' is provided with a fire viewport 921' which is connected with the fireplace chamber 91'. A cavity 93' is formed at the bottom of the fireplace chamber 91'. The cavity 93' is provided with a combustion device for the gasified liquid fuel to burn.

The combustion device of the present embodiment includes a gasification chamber 1', a burner 2', an electric heating means 3', a liquid fuel tank 4' and a feed tube 5'. The liquid fuel tank 4' and the gasification chamber 1' are connected by the feed tube 5'. The feed tube 5' is also provided with an electromagnetic pump 51' which supplies power to deliver liquid fuel. The liquid fuel tank 4' is provided with a liquid inlet 41' and a liquid level indicator 42' at the top.

The structure of the burner used in embodiment 2 is the same as that in the embodiment 1. The top of burner 2' is provided with a flame jet hole 21'. A slot 931' is provided at the top of the cavity 93'. The burner 2' passes through the slot 931' and is exposed in the fireplace chamber 91'. The burner can be tubular with either straight pipe structure or other structures, such as bent pipe structure as shown in FIG. 7 or disk structure. The electronic heating means 3' and its installation are same with that of the embodiment 1 and will not be described in detail herein.

The burner 2' of this embodiment is provided with an igniter 7' close to the flame jet hole 21' at one side. The burner 2' is provided with a flame detection means 8' close to the flame jet hole 21' at another side. The flame detecting means 8' is used to detect whether the flame of the burner 2' is at normal operation status. The outer wall of the gasification chamber 1' is provided with a temperature sensor 11' which detects whether the temperature of the gasification chamber 1' is at a normal operation status.

The top of the gasification chamber 1' is provided with a liquid level hole. The liquid level hole is provided with a liquid level sensor 12'. The liquid level sensor 12' is used to detect whether the liquid level is normal. To further improve the accuracy of the liquid level detecting, a separate liquid level chamber can be established for accommodating the liquid level sensor 12'. The liquid level chamber can be connected with the electromagnetic pump 51' and the gasification chamber 1' by pipe. The electromagnetic pump 51', the igniter 7', the flame detecting means 8', the temperature sensor 11', the liquid level sensor 12' and the electronic control means 3' are electrically connected to the electric control means 6' by wires and form a feedback control system.

When the electromagnetic pump 51' is turned on and the electronic heating means 3' is power on, the igniter 7' can ignite the burner 2' automatically under the control of the electronic control means 6'. If the flame detection device 8' detects flame at the flame jet hole, the flame detection device 8' sends signal to the electronic control means 6'. The electronic control means 6' control the igniter 7' to stop work so that the burner 2' can achieve stable combustion.

If the flame detection device 8' detects that the burner 2' is at an abnormal combustion status, like the igniter 7' fails to ignite or the flame of burner 2' quench abnormally or the combustion is unstable, the flame detecting means 8' send feedback signal to the electronic control means 6'. Then the electronic control means 6' controls the electric heating means 3' to stop work and thus the trouble is removed.

When the temperature sensor 11' detected the temperature of the gasification chamber 1' is too high, the temperature sensor 11' feedbacks the temperature signal to the electronic control means 6'. The electronic control means 6' changes the heating power of the electronic heating means 3', for example, stop heating or reduce the heating power. This configuration can ensure the temperature in the gasification chamber 1' is at a normal status and thus prevent overheating of the gasification chamber 1'.

The gasification chamber 1' may also be provided with a pressure sensor inner (not shown in the Figures) which is electrically connected with the electronic control means 6'. The pressure sensor and the temperature sensor 11' provide a dual protection. The pressure sensor detects the pressure signal of the gasified fuel inside the gasification chamber 1' and sends the signal to the electronic control means 6'. When the pressure of the vaporized fuel in the gasification chamber 1' exceeds the normal operating pressure, the electronic control unit 6' can close the power supply of the electric heating device provided in the gasification chamber and the electromagnetic pump power provided on the hydraulic unit.

When the liquid level sensor 12' detects the liquid fuel in the gasification chamber 1' is excessive, the liquid level sensor 12' feedbacks the liquid level signal to the electronic control means 6'. The electronic control means 6' sends a control signal to the electromagnetic pump 51' to turn it off. The liquid fuel tank 4' stops the fuel supply to the gasification chamber 1'. When the liquid level sensor 12' detects the liquid fuel in the gasification chamber 1' is in a shortage, the liquid level sensor 12' feedbacks the liquid level signal to the electronic control means 6'. The electronic control means 6' sends a control signal to the electromagnetic pump 51' to turn it on to supply the liquid fuel to the gasification chamber 1'. Or the electronic control means 6' controls the electronic heating means 3' to stop working to prevent overheating of the gasification chamber 1' or dry burning.

To further improve the using safety of the fireplace, the electronic control means 6' is connected with a carbon dioxide sensor 61'. The carbon dioxide sensor 61' is used to detect the concentration of indoor carbon dioxide. When the concentration of indoor carbon dioxide exceeds the set value, the electrical control means 6' shuts off the combustion apparatus in the fireplace so that to fully ensure the user's safety.

In order to control the combustion temperature of the fireplace conveniently, the electronic control means 6' may also be connected with a room temperature sensor 62' to detect the room temperature and an oven temperature sensor 63' to detect the temperature in the fireplace chamber of the fireplace. By the measurement of room temperature and oven temperature, the automatic detection and control of the combustion temperature of the fireplace can be achieved for better energy saving and better use of comfort.

In addition, the combustion apparatus further includes decorative lights panel 64' which is electrically connected to the electronic control means 6'. The decorative lights panel 64' is used for lighting the inside or outside of fireplace body 9' to produce a more beautiful and rich visual effects. The lamp of the decorative light panel 64' can use ordinary energy-saving lamps, fluorescent or LED, and etc. In particular, the lamp can be a three primary colors (RGB) LED lamps set which can produce lighting effects with different colors and brightness by controlling. Combining with the burning flame of the liquid fuel gasification combustion, it can create a warm, sweet and romantic atmosphere.

The electronic control means 6' of this embodiment can be achieved by a variety of existing control devices (such as a microcontroller, PLC, and etc.) and control circuit. The control circuit and equipment are not the main object which this embodiment intent to protect, the detailed description of the structure and control circuit of the electronic control means 6' is omitted here.

In this embodiment, the electronic control means 6' can adjust the heating power of the electronic heating means 3' so that to change the amount of gasified liquid fuel. Therefore the accurate and continuous adjustment of the heating power of the combustion apparatus with gasified liquid fuel can be achieved. This can make the combustion apparatus more safe and reliable.

The invention claimed is:

1. A fireplace of combusting gasified liquid fuel, comprising: a fireplace body provided with a fireplace chamber, the fireplace body is provided with a cavity which is capable of accommodating a combustion device and formed at the bottom of the fireplace chamber; a fire viewport is provided at the front of the fireplace body;

wherein the combustion device comprises a liquid supplying device, a gasification chamber and a burner; a slot used for the burner passing through and exposing is provided at the top of the cavity; a flame jet hole is arranged in the burner; a liquid fuel feeding port and a gas outlet are arranged in the gasification chamber; the liquid fuel feeding port of the gasification chamber is connected with the liquid supplying device, and the gas outlet of the gasification chamber is connected with the burner; a main body of the burner is provided higher than the connection port of the burner and the gasification chamber; and an electric heating means is provided in the gasification chamber; and further wherein the burner has a tubular shape; the flame jet hole is provided at an interval along the longitudinal direction of the wall of the burner; the top or side of the gasification chamber is provided with a gas outlet port; and the gas outlet port of the gasification chamber connects to the corresponding pipe orifice of the burner.

2. The fireplace of combusting gasified liquid fuel in claim 1, wherein a demountable fireplace door is provided at the front of the fireplace body; and the fire viewport is set in the fireplace door.

3. The fireplace of combusting gasified liquid fuel in claim 1, wherein a through hole along the longitudinal direction is provided at the bottom of the gasification chamber; and the electric heating means is interposed in the through hole.

4. The fireplace of combusting gasified liquid fuel in claim 3, wherein the electric heating means is an electric heating metal tube, or a PTC heating element, or a heating resistance wire, or an electromagnetic induction heating coil.

5. The fireplace of combusting gasified liquid fuel in claim 1, wherein the combustion device further comprises an electronic control means which controls the power and on-off status of the electric heating means; the burner is provided with a igniter close to the flame jet hole; the burner is provided with a flame detection means close to the flame jet hole; the flame detecting means detects whether the flame of the burner is at a normal operation status or not; and the igniter, the flame detecting means and the electric heating means are electrically connected by the electronic control means.

6. The fireplace of combusting gasified liquid fuel in claim 5, wherein an outer side wall of the gasification chamber is provided with a temperature sensor which detects an operating temperature of the gasification chamber; and the temperature sensor is also electrically connected to the electric control means.

7. The fireplace of combusting gasified liquid fuel in claim 5, wherein the liquid supply means comprises a liquid fuel tank and a feed tube; a discharge port of the liquid fuel tank and the liquid fuel feeding port of the gasification chamber are connected via the feed tube; the feed tube is also provided with an electromagnetic pump which supplies power to deliver liquid fuel; and the electromagnetic pump is electrically connected with the electrical control means.

8. The fireplace of combusting gasified liquid fuel in claim 5, wherein a top of the gasification chamber is provided with a liquid level hole; the liquid level hole is provided with a liquid level sensor which is electrically connected with the electronic control means; the liquid level sensor detects the liquid level signal and sends it to the electronic control means; if the liquid fuel in the gasification chamber is over capacity, the electronic control means controls the electromagnetic pump to shut off; if the liquid fuel in the gasification chamber is in a shortage, the electronic control means controls the electromagnetic pump to turn on or controls the electronic heating means to stop working.

9. The fireplace of combusting gasified liquid fuel in claim 5, wherein the electronic control means is connected with a carbon dioxide sensor which detects the concentration of indoor carbon dioxide.

10. The fireplace of combusting gasified liquid fuel in claim 6, wherein the electronic control means is connected with a carbon dioxide sensor which detects the concentration of indoor carbon dioxide.

11. The fireplace of combusting gasified liquid fuel in claim 7, wherein the electronic control means is connected with a carbon dioxide sensor which detects the concentration of indoor carbon dioxide.

12. The fireplace of combusting gasified liquid fuel in claim 8, wherein the electronic control means is connected with a carbon dioxide sensor which detects the concentration of indoor carbon dioxide.

13. A fireplace of combusting gasified liquid fuel, comprising: a fireplace body provided with a fireplace chamber, the fireplace body is provided with a cavity which is capable of accommodating a combustion device and formed at the bottom of the fireplace chamber; a fire viewport is provided at the front of the fireplace body;

wherein the combustion device comprises a liquid supplying device, a gasification chamber and a burner; a slot used for the burner passing through and exposing is provided at the top of the cavity; a flame jet hole is arranged in the burner; a liquid fuel feeding port and a gas outlet are arranged in the gasification chamber; the liquid fuel feeding port of the gasification chamber is connected with the liquid supplying device, and the gas outlet of the gasification chamber is connected with the burner; a main body of the burner is provided higher than the connection port of the burner and the gasification chamber; and an electric heating means is provided in the gasification chamber;

wherein a through hole along the longitudinal direction is provided at the bottom of the gasification chamber; and the electric heating means is interposed in the through hole; and wherein the electric heating means is an electric heating metal tube, or a PTC heating element, or a heating resistance wire, or an electromagnetic induction heating coil.

14. The fireplace of combusting gasified liquid fuel in claim 13, wherein a demountable fireplace door is provided at the front of the fireplace body; and the fire viewport is set in the fireplace door.

15. The fireplace of combusting gasified liquid fuel in claim 13, wherein the combustion device further comprises an electronic control means which controls the power and on-off status of the electric heating means; the burner is provided with a igniter close to the flame jet hole; the burner is provided with a flame detection means close to the flame jet hole; the flame detecting means detects whether the flame of the burner is at a normal operation status or not; and the igniter, the flame detecting means and the electric heating means are electrically connected by the electronic control means.

16. A fireplace of combusting gasified liquid fuel, comprising: a fireplace body provided with a fireplace chamber, the fireplace body is provided with a cavity which is capable of accommodating a combustion device and formed at the bottom of the fireplace chamber; a fire viewport is provided at the front of the fireplace body;

wherein the combustion device comprises a liquid supplying device, a gasification chamber and a burner; a slot used for the burner passing through and exposing is provided at the top of the cavity; a flame jet hole is arranged in the burner; a liquid fuel feeding port and a gas outlet are arranged in the gasification chamber; the liquid fuel feeding port of the gasification chamber is connected with the liquid supplying device, and the gas outlet of the gasification chamber is connected with the burner; a main body of the burner is provided higher than the connection port of the burner and the gasification chamber; and an electric heating means is provided in the gasification chamber;

wherein the combustion device further comprises an electronic control means which controls the power and on-off status of the electric heating means; the burner is provided with a igniter close to the flame jet hole; the burner is provided with a flame detection means close to the flame jet hole; the flame detecting means detects whether the flame of the burner is at a normal operation status or not; and the igniter, the flame detecting means and the electric heating means are electrically connected by the electronic control means;

wherein an outer side wall of the gasification chamber is provided with a temperature sensor which detects a working temperature of the gasification chamber; and the temperature sensor is also electrically connected to the electric control means; and wherein the liquid supply means comprises a liquid fuel tank and a feed tube; a discharge port of the liquid fuel tank and the liquid fuel feeding port of the gasification chamber are connected via the feed tube; the feed tube is also provided with an electromagnetic pump which supplies power to deliver liquid fuel; and the electromagnetic pump is electrically connected with the electrical control means.

17. The fireplace of combusting gasified liquid fuel in claim 16, wherein a top of the gasification chamber is provided with a liquid level hole; the liquid level hole is provided with a liquid level sensor which is electrically connected with the electronic control means; the liquid level sensor detects the liquid level signal and sends it to the electronic control means; if the liquid fuel in the gasification chamber is over capacity, the electronic control means controls the electromagnetic pump to shut off; if the liquid fuel in the gasification chamber is in a shortage, the electronic control means controls the electromagnetic pump to turn on or controls the electronic heating means to stop working.

18. The fireplace of combusting gasified liquid fuel in claim 16, wherein the electronic control means is connected with a carbon dioxide sensor which detects the concentration of indoor carbon dioxide.

* * * * *